US009960468B2

(12) United States Patent
Cahill et al.

(10) Patent No.: US 9,960,468 B2
(45) Date of Patent: May 1, 2018

(54) METALIZED MOLDED PLASTIC COMPONENTS FOR MILLIMETER WAVE ELECTRONICS AND METHOD FOR MANUFACTURE

(75) Inventors: Sean S. Cahill, Palo Alto, CA (US); Eric A. Sanjuan, San Jose, CA (US)

(73) Assignee: REMEC BROADBAND WIRELESS NETWORKS, LLC, San Diego, CA (US)

( * ) Notice: Subject to any disclaimer, the term of this patent is extended or adjusted under 35 U.S.C. 154(b) by 1008 days.

(21) Appl. No.: 13/607,539

(22) Filed: Sep. 7, 2012

(65) Prior Publication Data

US 2014/0070904 A1 Mar. 13, 2014

(51) Int. Cl.

| | |
|---|---|
| ***H01P 1/208*** | (2006.01) |
| ***H01P 1/213*** | (2006.01) |
| ***H01P 5/12*** | (2006.01) |
| ***H01P 1/207*** | (2006.01) |
| *H01P 11/00* | (2006.01) |

(52) U.S. Cl.

CPC ..... *H01P 1/208* (2013.01); *H01P 1/207* (2013.01); *H01P 1/213* (2013.01); *H01P 1/2138* (2013.01); *H01P 5/12* (2013.01); *H01P 11/002* (2013.01); *Y10T 29/49016* (2015.01)

(58) Field of Classification Search

CPC .... H01P 1/20; H01P 1/20336; H01P 1/20354; H01P 1/2056; H01P 1/207; H01P 1/208; H01P 1/213; H01P 1/2136; H01P 1/2138; H01P 5/12

USPC ..... 333/126, 127, 129, 132, 134–137, 333/208–212

See application file for complete search history.

(56) References Cited

U.S. PATENT DOCUMENTS

| | | | | |
|---|---|---|---|---|
| 3,955,161 | A | 5/1976 | MacTurk | |
| 4,559,281 | A | 12/1985 | Derfler et al. | |
| 4,700,154 | A * | 10/1987 | Schuegraf | H01P 1/161 333/125 |
| 4,792,770 | A | 12/1988 | Parekh et al. | |
| 4,970,480 | A | 11/1990 | Wong et al. | |
| 5,182,849 | A | 2/1993 | Marco | |
| 5,329,687 | A * | 7/1994 | Scott | H01P 1/205 29/527.2 |
| 5,352,645 | A | 10/1994 | Schwartz | |
| 5,380,386 | A | 1/1995 | Oldham et al. | |
| 6,060,961 | A | 5/2000 | Moheb et al. | |

(Continued)

FOREIGN PATENT DOCUMENTS

| | | |
|---|---|---|
| EP | 1 052 721 | 11/2000 |
| WO | WO 98/42486 | 10/1998 |
| WO | WO 03/011776 | 2/2003 |

OTHER PUBLICATIONS

W. Menzel; "Packaging and Interconnect Techniques for Complex Millimeter-Wave Front-Ends"; 28th European Microwave Conference Amsterdam 1998, pp. 497-502.*

(Continued)

*Primary Examiner* — Barbara Summons

(74) *Attorney, Agent, or Firm* — DLA Piper LLP (US)

(57) ABSTRACT

Waveguide components that have a high degree of performance accuracy over the temperature range of interest are provided. The components require no post-formation trimming steps, are light-weight, and dimensionally stable. In addition, a method for the manufacture of these millimeter wave components is provided.

15 Claims, 6 Drawing Sheets

(56) References Cited

U.S. PATENT DOCUMENTS

| | | | | |
|---|---|---|---|---|
| 6,169,136 | B1 * | 1/2001 | Iriguchi | C08K 3/36 524/492 |
| 6,255,917 | B1 * | 7/2001 | Scott | H01P 1/2053 29/527.2 |
| 6,302,184 | B1 | 10/2001 | Moheb et al. | |
| 6,809,696 | B1 | 10/2004 | Bergmark et al. | |
| 7,091,804 | B2 | 8/2006 | Aramaki et al. | |
| 7,127,796 | B2 * | 10/2006 | Mukuda | H01P 3/121 29/593 |
| 7,474,173 | B2 * | 1/2009 | Avramis | H01P 1/161 333/126 |
| 7,573,430 | B2 | 8/2009 | Bergmark et al. | |
| 7,663,452 | B2 | 2/2010 | Rauscher | |
| 7,847,658 | B2 * | 12/2010 | Lyons | C08J 9/0066 333/202 |
| 8,230,564 | B1 * | 7/2012 | Reid, Jr. | H01P 1/2053 174/256 |
| 2007/0139135 | A1 | 6/2007 | Ammar et al. | |

OTHER PUBLICATIONS

R. Vahldieck et al.; Millimeter Wave Filters for Low-Cost Mass-Fabrication; IEEE Proceedings of APMC2001, Taipei, Taiwan, R.O.C., 2001, pp. 513-518.*

H. Asao et al.; "Metal-Plated Plastic Waveguide Filter Using Injection Molding Process"; 2003 IEEE MTT-S Digest, 2003, pp. 941-944.*

PCT International Search Report of PCT/US13/58505; dated Feb. 7, 2014 (2 pgs.).

PCT Written Opinion of PCT/US13/58505; dated Feb. 7, 2014 (9 pgs.).

Thermoset Microwave Materials. Rogers Corporation. May, 2008; p. 1, paragraph 3 [online] [Retrieved on Jan. 14, 2014] Retrieved from the internet <URL: http://web/archive.org/web/20090214085016/http://rogerscorp.com/documents/728/acm/TMM-Thermoset-larninate-data-sheet-TMM2-TMM4-TMM6-TMM10-TMM10i.aspx (2pgs.).

* cited by examiner

METALIZED MOLDED PLASTIC COMPONENTS FOR MILLIMETER WAVE ELECTRONICS AND METHOD FOR MANUFACTURE

FIELD

The disclosure relates to methods for fabricating high-frequency waveguide components and, in particular, to methods for fabricating high-frequency waveguide components that are suitable for creating components designed to operate at millimeter wave (20 to 200 GHz) frequencies.

BACKGROUND

The operation of wireless communication systems at ever higher frequencies is desired because of higher data rates and capacities achievable with higher frequency and available bandwidths. Thus, millimeter wave (MMW) systems (e.g., operating at 20-200 GHz) are addressing wireless communication needs and becoming increasingly used. Such MMW systems require guided-wave structures in order to route signals efficiently. These guided-wave structures include various planar implementations (coplanar waveguide, microstrip, stripline) and machined waveguides. Several factors influence the choice of guided-wave structure, including the ultimate performance and the cost.

Planar guided-wave approaches are very attractive because they can be realized using low cost processes. Although it is possible to utilize planar structures to make passive elements such as diplexers, filters, and resonators, the resulting devices typically are limited in performance. The reason for the limited performance can be seen when one compares a property of resonators called the Intrinsic Quality Factor, or Q, and the ultimate performance of components in terms of loss. Q is a ratio of total energy stored in a resonator and the loss per resonant cycle. Q is affected by multiple physical factors such as resonator shape and surface quality that affect how currents flow in the resonator, how energy can radiate and thus is an intrinsic measure of factors influencing loss and efficiency. Performance for any given passive structure configuration, such as a filter, improves with higher Q. Sharper filter roll-off requires greater numbers of resonators, and as the number of resonators in a structure increases (typically ranging from 2 to 10 resonators), so does the insertion loss. Also, the narrower the bandwidth of the filter as a percentage of the operational frequency, the greater is its insertion loss. The greater the Q, the less these loss imposing factors diminish performance.

Planar elements, with Q factors in the 100-250 range, are adequate for many MMW system components such as image reject filters, or other filters with large bandwidths. Efforts have been made to create quasi-planar MEMS-based filters on membranes because an air dielectric has very low loss, approaching that of vacuum. Filters of this variety have demonstrated Q factors nearing 400. On the other hand, machined waveguide elements have achieved Q numbers more than an order of magnitude higher than those of the planar structures. As a result, machined waveguides are commonly found in MMW systems. Unfortunately, these machined waveguides are usually individually fabricated from metals, which add weight and expense to the system. Additionally, the necessary accuracy of these structures adds to their expense, either because of costly precision machining steps for each element, or labor content required to compensate for machining inaccuracies with tuning screws or other adjustment means. Thus, there is a need for performance levels achievable with machined waveguide, but without the cost penalties associated with typical fabrication techniques for these components, and preferably without the considerable weight penalty of metallic materials.

Others have recognized these needs and have sought to reduce cost through molding techniques. The machining accuracy necessary to produce a single nearly-perfect waveguide element could in concept be employed to make a complementary mold tool and the resultant molded part would repeat the desired dimensions if it can be consistently processed. Many suitable materials, including metals, ceramics, and plastics can be cast and/or molded.

MMW components are typically used over the range of −55 to 125° C. They often are used in combination with soldered components that are processed in a typical range of 210-260° C. for short periods of time. In order to have consistent electrical characteristics, MMW waveguide components should exhibit very low thermal and mechanical hysteresis and thus should be operated well below the softening point (or glass transition temperature) of their constituent materials and should have high flexural strength and high elastic modulus. Another desirable characteristic is for the thermal expansion characteristic to be relatively low, both for minimal thermal impact over the range of operation, and to minimize stresses at material interfaces and mating surfaces with other components. Many metals and ceramics exhibit the desired characteristics, but very few plastics do so. Despite this, plastics remain very attractive for weight and cost reasons. Thus, there is a need for advantages that can be realized with plastic materials, while maintaining thermal and mechanical stability of ceramics and metals.

The vast majority of reported approaches have exploited thermoplastic materials. Thermoplastics are attractive for reasons of material reuse and process simplicity, but have several drawbacks. Most thermoplastics are high molecular weight materials whose side chains interact through intermolecular forces that diminish with sufficient heating and reform spontaneously upon cooling. This is the property that permits ease of reuse. Thermoplastics are thus processed above their glass transition temperature and near their respective melt temperatures. Typical techniques for forming parts from thermoplastics include injection molding of melted material or hot embossing of heat softened material. In order to achieve thermal stability adequate to the MMW application, melt temperature should be higher than 230° C. By this criterion, candidate thermoplastics include (Tm/Tg): PET-PBT (230-260° C./70-80° C.), polycarbonate (265° C./150° C.), PEEK (340° C./143° C.), PTFE (327° C./−97° C.) and polystyrene (240° C./100° C.), among others. At temperatures exceeding the glass transition temperature, intermolecular forces diminish and the polymer typically begins to soften and expand substantially with temperature. This property leads to undesirable stresses on the resultant parts, and creep which creates thermo-mechanical hysteresis. The result is that parts operated too far above glass transition for these thermoplastic materials distorts in ways that cause drift in the geometry of the part and the consequent electrical properties. PEEK and polycarbonate would seem to be candidates by this latter criterion. These materials have thermal expansion coefficients of 30-50 ppm/° C. and 65 ppm/° C., respectively. This means that over the operational temperature range of the parts fabricated from these materials, they will expand by a factor of 2-3× more than typical metal coatings applied to the parts (11-22 ppm/° C.). This again is a source of thermo-mechanical hysteresis, and a source of reliability issues such as metal delamination.

Mechanical properties of thermoplastics can be adjusted through the use of fillers, including flakes, spheroids, and fibers of other stiff materials such as glass and carbon, limiting the thermal expansion of the material. Nonetheless, the materials still soften and deform above the glass transition. Non-spherical fillers such as fibers become oriented during the flow of the molding process. This anisotropic orientation leads in-turn to unpredictable anisotropic thermal expansion characteristics. This effect is very clearly seen in glass fabric-reinforced printed circuit board materials, which have in-plane thermal expansion of 11-14 ppm/° C., and normal axis expansion ranging from 35-46 ppm/° C. When the fiber orientation is not closely controlled, temperature excursions result in bend and warpage of resultant parts that are unrepeatable, with consequent implications for utility of such parts in a MMW system.

Thus, there is a need for plastic parts with formation temperature <250° C., glass transition in excess of 160° C., thermal expansion coefficient matching those of typical metal coatings or mating parts, isotropic thermal expansion, high rigidity, and excellent dimensional control to eliminate the need for post-processing or adjustment. A solution with these properties and low-cost is needed to address the MMW waveguide component application.

Thermoset plastic materials are reactive in nature. This means that they form highly cross-linked networks that allow them to be quite stiff and mechanically stable. The materials are often found in liquid form, reacted upon mixing, and once cured may not be remelted. This irreversible process is often seen as a deficit for thermoset materials, as they are difficult to rework or recycle. Another type of thermoset material is found commonly in the semiconductor industry to create plastic encapsulated microcircuits. Such materials are unreacted solid mixtures, typically in pellet form, heated to a temperature at which they will flow, injected into the heated mold through a sprue and runner system, reacted in the mold at elevated temperature, then removed from the mold once partially cured. The temperature of formation is typically substantially lower than the limit of operation for the material. The process is known as transfer molding, and has very high reproduction accuracy. Because of the reactive nature of the thermoset material, adhesion to metals and fillers can be quite good, as is evidenced by the ubiquity of these materials for the aforementioned semiconductor packaging application.

Thermoset materials have been considered for the MMW waveguide component application. For example, thermoset materials have been used to join and seal multiple thermoplastic parts. Furthermore, castable materials may be used to form a matrix into which various metal and ceramic waveguide components are embedded in order to create a single assembled hybrid structure wherein thermoset plastics were one possibility for the exterior casting. However, none of the present systems and method have used thermoset plastic to manufacture MMW components and it is to this end that the disclosure is directed.

DETAILED DESCRIPTION OF ONE OR MORE EMBODIMENTS

Figures 1, 1B:
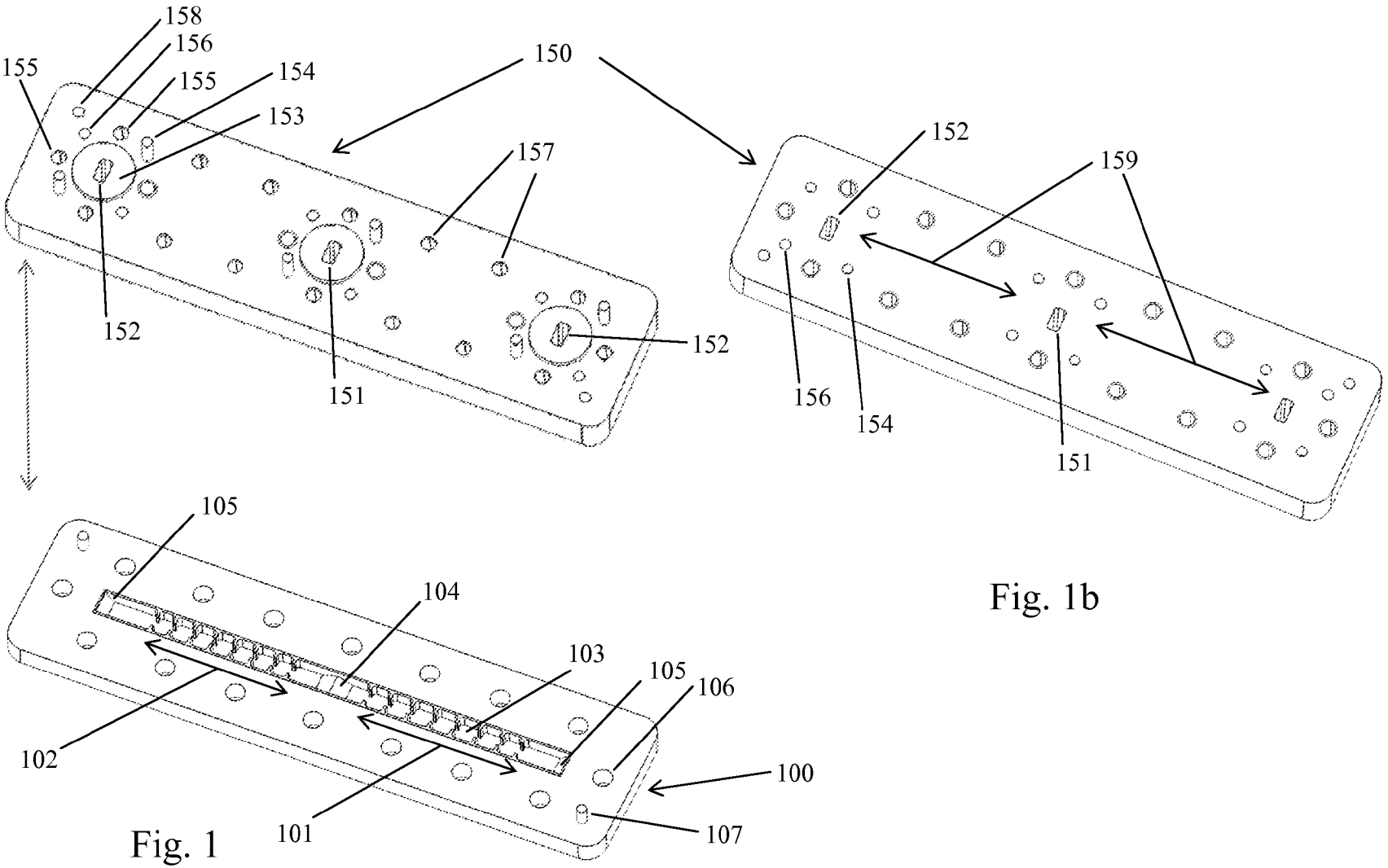
FIG. 1 illustrates a molded diplexer base and lid.
FIG. 1*b* shows an internal surface of the molded diplexer lid.

The disclosed device and manufacturing process is particularly applicable to waveguide-based devices operating in the millimeter-wave (20-200 GHz) range. It is in this context that the disclosure will be described. It will be appreciated, however, that the device and its creation method can be used with systems that operate at frequencies more than an order of magnitude smaller or greater than the millimeter wave range and can also be used in any system where light-weight, precision molded, high-frequency electronics may be utilized.

The MMW waveguide component device and method addresses the shortcomings of the current state of the art outlined above. The method provides waveguide components that have a high degree of performance accuracy over the temperature range of interest, require no post-formation trimming steps, are light-weight, and dimensionally stable.

An objective is to create MMW waveguide components using a low-cost thermoset plastic reactive transfer-molding process, in which the device is formed nearly entirely from reaction transfer molded thermoset plastic materials, the critical dimensions of which are formed in a single/monolithic piece. An additional objective is to utilize readily available materials with advantageous properties, not previously used to create MMW passive structures. Use of readily available suitable materials allows the use of low-cost constituents, further minimizing overall device costs.

A further objective is to achieve electrical performance as good, or better, than that achievable with generally available machined metal waveguide elements. In the component described below, this is achieved without any post-manufacturing trim steps; neither through further machining, nor adjustment of characteristics with screws, nor other adjustment means, but solely by using precision fabrication techniques and choosing appropriate materials.

Another objective is to achieve high dimensional accuracy both as-produced, and in operation. This is accomplished by using low-temperature processes, exploiting the excellent dimensional accuracy achievable in transfer mold tooling, and the advantageous thermo-mechanical properties of the reaction transfer molded plastic material; such properties including isotropic thermal expansion, low thermal expansion coefficient, repeatable thermal properties, and good mold fill characteristics. A further consequence of the well-matched thermal properties of the material is to allow good thermal match to metal parts (plastics typically have much higher thermal expansion than metals), in turn permitting the inclusion of metallic structures on the exterior of the part for heat spreading, fastening, and attachment to other components within a MMW system without creating potentially destructive stresses in the part or related assemblies. The waveguide components are mechanically very stable over the environmental temperature range of −55 to 125° C., and the operational temperature range of −25 to 85° C. Furthermore, the method described below produces light-weight waveguide devices that allow inclusion of high-performing waveguide components into payload sensitive applications.

The structure of the waveguide is composed substantially of reaction transfer molded thermoset plastic materials, the critical dimensions of which may be formed in a single piece. This single-piece (or monolithic) construction allows precision and repeatability of position for the critical elements within a waveguide based device, such as a filter, diplexer, coupler, etc. The thermoset material may be insulating or somewhat conductive. The primary function of the plastic is to create precision features and provide an overall structure for the desired part. The waveguides typically require conductive surfaces and these are added to the plastic surface as described below in more detail.

At the MMW frequencies of interest (20-200 GHz), high conductivity of the internal features and surfaces of the waveguide elements is necessary in order to achieve low-loss performance, but bulk conductivity is not required. Currents are concentrated in thin layers near the surface of conductors, a property known as the Skin Effect. Skin Depth is a measure of the depth at which the current density falls to 1/e of its value near the surface of a given conductor. Over 95% of the current will flow within a layer three times the skin depth from the surface. This is as distinct from direct current, for which current typically is distributed evenly over the cross-section of the conductor. Skin Depth decreases with increasing frequency, thus surface roughness of a conductor becomes a concern as operation frequency increases. Skin Depths for typical conductors at 20 GHz (in microns) is 0.579 for aluminum, 0.462 for copper, 0.528 for gold, and 0.455 for silver. Thus, 2 microns of smooth conductor is sufficient to achieve good performance, and more than this will improve performance further, although marginally.

The waveguide devices exhibit very low insertion loss due to excellent conductivity of the internal surfaces. The required surface conductivity of the final parts is achieved through the addition of thin, uniform, highly-conductive surface coatings. Several methods are possible for the addition of such coatings including sputtering of a conductive seed layer and subsequent electroplating or electroless plating. Sputtering allows for the deposition of a thin, highly adhesive layer at the interface between the molded plastic and the highly conductive layer. An example is the deposition of a few hundred angstroms of titanium, or titanium-tungsten alloy, a subsequent 1000+ angstrom deposition of gold, followed by electroless plating of 3 microns of gold. An alternative approach is to chemically activate the plastic surface, deposit a layer of electroless nickel approximately 1 micron thick, followed by electroless plating of gold approximately 4 microns thick. All internal surfaces of the molded parts are formed of the thermoset plastic and are then coated with a conductor in a manner similar to that described above to achieve adequate conductivity.

Transfer molding such as practiced for creation of semiconductor electronics packages has distinct advantages for formation of waveguide components. First, the reactive aspect of the transfer molding process allows for relatively low viscosity materials to be injected at the beginning of the process to fill the mold tooling. Thus, thin high-aspect ratio features with very small tolerances can be filled repeatably with the mold material. These materials start off as multi-component powders pressed into pellets, and typically stored in pellet-form at around 0° C.

Mold inserts within the mold tooling are the precisely machined elements that create the complementary structure which results in the final molded part. Very high accuracies within and between functional elements (such as filter apertures) are required for good performance of a resultant molded part. The pieces of the mold insert may be fabricated separately and subsequently aligned, but this creates many degrees of freedom for the relative positioning of constituent mold insert elements, and creates the opportunity for misalignment of critical features comprising the functional elements. Therefore, it is preferred that the mold insert containing critically dimensioned features be created from as few pieces as possible, ideally one or two. Thus a high-precision and high-resolution machining technique is required to create the mold insert. Such a technique suitable to create small dimensions with precision is wire-fed electro-discharge machining, also called WEDM. The diameter of the fed wire, along with its characteristic erosion offset determines the ultimate minimum feature dimension and fillet radius which may be achieved using this technique. External corners of resultant mold tools may have arbitrarily small radii, limited by the mold insert material properties. Internal corner mold tool radii are limited to the fillet radius described above. In practice, internal radii of 70 microns are readily achievable. Features can be positioned within 5 microns target, and feature run out over the length of an 80 mm part of less than 15 microns has been achieved. This level of precision is sufficient to the production of MMW molded devices.

Another consideration in the fabrication and design of mold tooling is that the molded part must eventually be removed from the tooling. Any re-entrant features will lock the molded piece into the tooling. In fact, walls that are substantially vertical in the direction of the ejection are undesirable as well. Features, such as are desirable in waveguide devices, having thin section and high aspect ratio will be difficult to remove from the tooling without damage to the resultant molded part. In order to minimize the stresses on the part, and to reduce ejection forces, it is typical for mold tooling to have a slight angular draft along the direction of ejection. This draft angle is typically found in the range of 0.5° to 2.0°, depending on the associated molded part section and the total length along the ejection axis. Thin and long parts need larger angles, wide and shallow parts can utilize smaller angles.

To begin the molding process, pellets are placed in a transfer pot and preheated to a temperature just below melting. A transfer plunger is activated, compressing and further heating the pellets, forcing the melting/mixing/reacting material through runners and gates into the mold cavities under high pressure. The pressure is maintained for an optimized time and pressure profile to ensure complete filling of the cavities. Small vents provided in the transfer mold allow the escape of trapped air, but these vents are small enough that the viscosity and surface tension of the melt prevents mold compound from escaping as well. The mold temperature is optimized to allow rapid curing of the part, but kept low enough so that premature cure does not occur in advance of complete filling. Once filled, the material viscosity increases until gelation occurs, at which point the material is locked into a highly cross-linked network. After 1-3 minutes at a typical molding temperature of 175° C., the mold compound is partially cured and may be removed from the mold. The resultant part is then cured for 4-16 hours at 175° C. to complete the cure. Thus, cycle time in the mold itself is quite short and does not require temperature cycling of the mold, as would be the case for thermoplastic materials. The dynamically varying viscosity of the thermoset resin does present process challenges, requiring the optimization of temperatures, pressures, fill velocities, mold tool geometry, etc., so decades of experience in the use of these materials for semiconductor packaging applications is of great utility.

Mold compound may be composed entirely of epoxy resin, but more typically has additives such a flame retardants and ceramic fillers (e.g., silica and alumina) that allow adjustment of thermomechanical properties. Particle fillers vary in size and shape. Spherical filler materials are isotropic in their flow properties within the resin matrix, and thus distribute very evenly and expand evenly over a range of temperatures. The result is that the final material can be quite isotropic in its thermomechanical properties. Silica has a very low thermal expansion coefficient (0.55 e-6/° C.), and in combination with the highly cross-linked thermoset matrix, can be used to adjust thermal properties of the resin-filler mix over a wide range to match different materials. Thus a thermoset resin filled with high percentage (70+%) of small silica spheroids of varying diameters (<75 microns) is an excellent thermal expansion coefficient (11 ppm/° C.) match over a range of mechanical materials such as brass (16 ppm/° C.), steel (12 ppm/° C.), titanium (9 ppm/° C.), nickel (13 ppm/° C.), and Au (14 ppm/° C.). This is a significant advantage over other plastic materials, whose thermal expansions typically ranging from 20-60 ppm/° C.

This matching of thermal properties allows the implementation of high reliable thin-film conductive coatings, the incorporation of metallic heat spreaders, embedding of threaded inserts (e.g. PEM nuts), and mating to metal components that are part of a MMW system. To illustrate the disclosed MMW component and its method for manufacture, a diplexer waveguide is described and illustrated in the diagrams. However, the disclosed MMW component and its method for manufacture may be other types of waveguide devices.

FIGS. 1 and 1*b* show a perspective view of a molded diplexer waveguide structure (100) and its associated lid (150). In particular, FIG. 1 shows a top view of the waveguide structure and lid as they would be connected to each other to form the component while FIG. 1*b* shows a bottom view of the lid and the portions of the lid that interface with the elements of the waveguide structure. The particular diplexer depicted is designed to operate in the V-band at frequencies ranging from 57-64 GHz. An industry standard rectangular waveguide for this frequency range is known as WR-15, which is designed to propagate frequencies from 50-75 GHz. The number 15 in WR-15 designates the width (a-axis) of the waveguide in 0.01 inch increments, or approximately 0.15 inches. The depth of the waveguide (b-axis) is one-half the width, or approximately 0.075 inches. More precisely, WR-15 is 0.148" by 0.074" in cross-section. Conforming to standard is important in this context so that low-cost generally available structures may be used to interface with the diplexer. The direction of propagation of electromagnetic energy (z-axis) is mutually perpendicular to both a and b axes.

Figure 6:
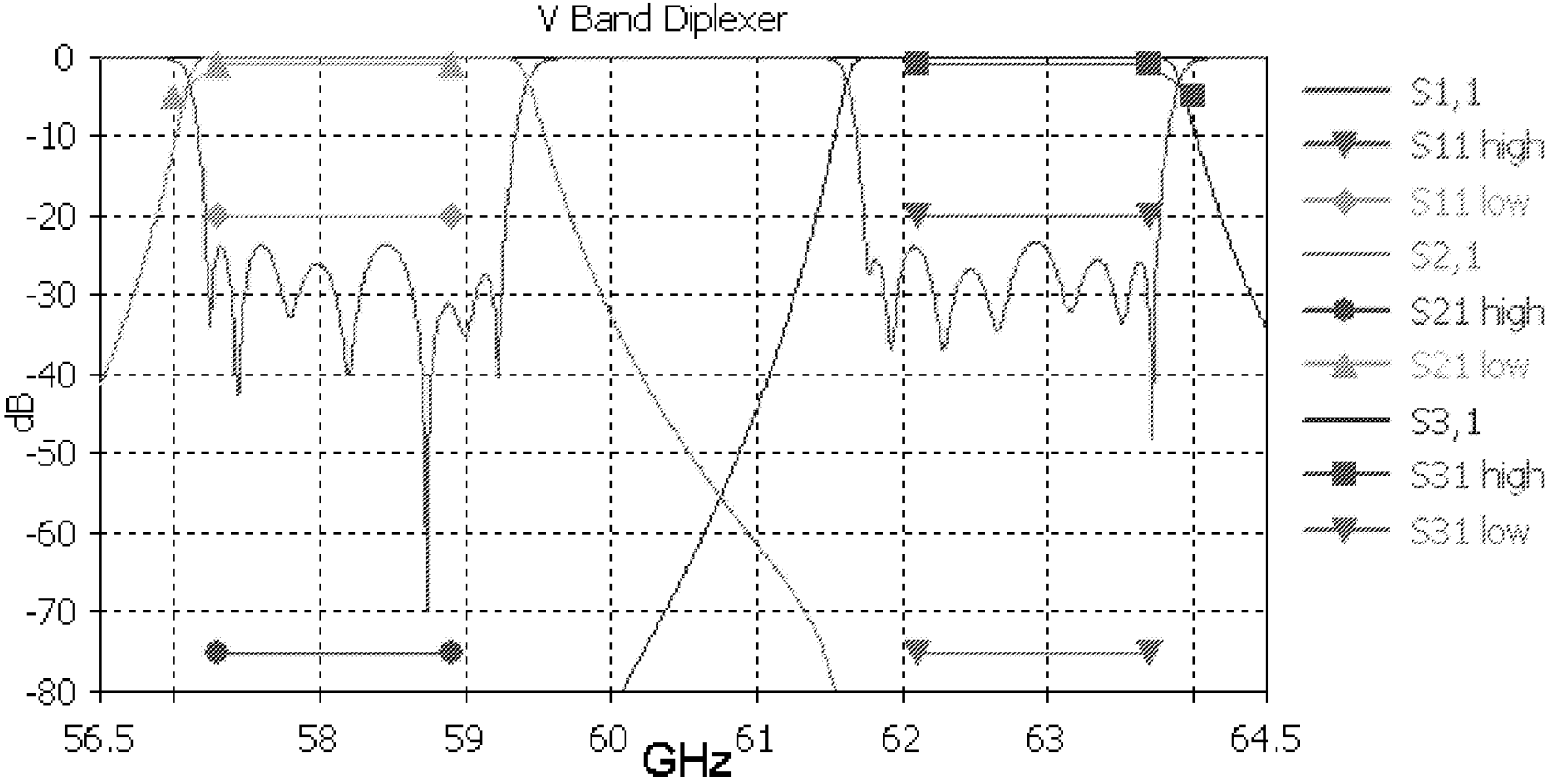
FIG. 6 illustrates a simulated Performance of V-band diplexer with above described features.

The diplexer is a three-port device designed to direct energy from a common port (151) towards either of two inlet/outlet ports (152) depending on the frequency of the energy. Conversely, the diplexer will accept energy from either inlet/outlet port (152), pass or block the energy depending on the frequency, and direct the passed energy to the common port (151). The frequency dependence of the paths within the diplexer is dependent on filtering characteristics of the two arms [(101) and (102)] of the diplexer. Arm (101) contains a filter that passes frequencies centered around 58.1 GHz, while arm (102) passes frequencies centered around 62.9 GHz. The diplexer frequency characteristics may be seen in FIG. 6. The diplexer base (100) contains all the structures that provide the filtering characteristics for the diplexer assembly. The associated lid (150) contains no critically dimensioned elements, and serves only to enclose the waveguide, provide waveguide inlet/outlets, and provide an interface to which standard waveguide structures, such as WR-15, may attach. Note that the lid regions (159) that interface with and are above the arms (101), (102) when the waveguide and lid are connected together are flat and featureless. These areas form one waveguide boundary along one a-axis surface.

Ports (151) and (152) are sized in accordance with the WR-15 standard. Each port has an associated seal surface (153), standard guide pins (154) and guide pin sockets (156) to facilitate alignment of separate components, and threaded screw holes (155) to accommodate waveguide mounting screws. The diplexer lid (150) and diplexer base (100) are themselves aligned for ease of assembly by molded guide pin (107) inserting into guide hole (158). The whole assembly is held together in precise alignment through a combination of the aforementioned waveguide mounting screws and auxiliary screws mounting into screw holes (157).

There are several critically dimensioned elements contained within the diplexer base (100). The floor (103) of the diplexer base is at a critical depth of 0.074" for WR-15. Variation in this depth along the waveguide will change the frequency dependent propagation characteristics of the device, and should be minimized. If a different waveguide structure standard is chosen, such as WR-12, the dimensions of the waveguide change accordingly and should similarly be precisely maintained. WR-12, being smaller in section, propagates higher frequencies over the range of 60-90 GHz. At each end of the diplexer base is a wedge (105) structure, which serves to change the direction of propagation of electromagnetic energy from being along the z-axis of the diplexer base (100) to a direction perpendicular, and normal to the plane of the device. Energy thus propagates in or out of the ports contained in the lid (150), and out along the z-axis of any attached waveguide. At the center of the diplexer base is a double-wedge structure (104) that allows energy to couple to common port (151), and similarly propagate in a direction perpendicular to the z-axis of the diplexer base (100), and normal to the plane of the device. Thus all three ports may face in the same direction, and may be coupled to the z-axis of the diplexer with structures (104) and (105) that are molded into the base.

Figure 2:
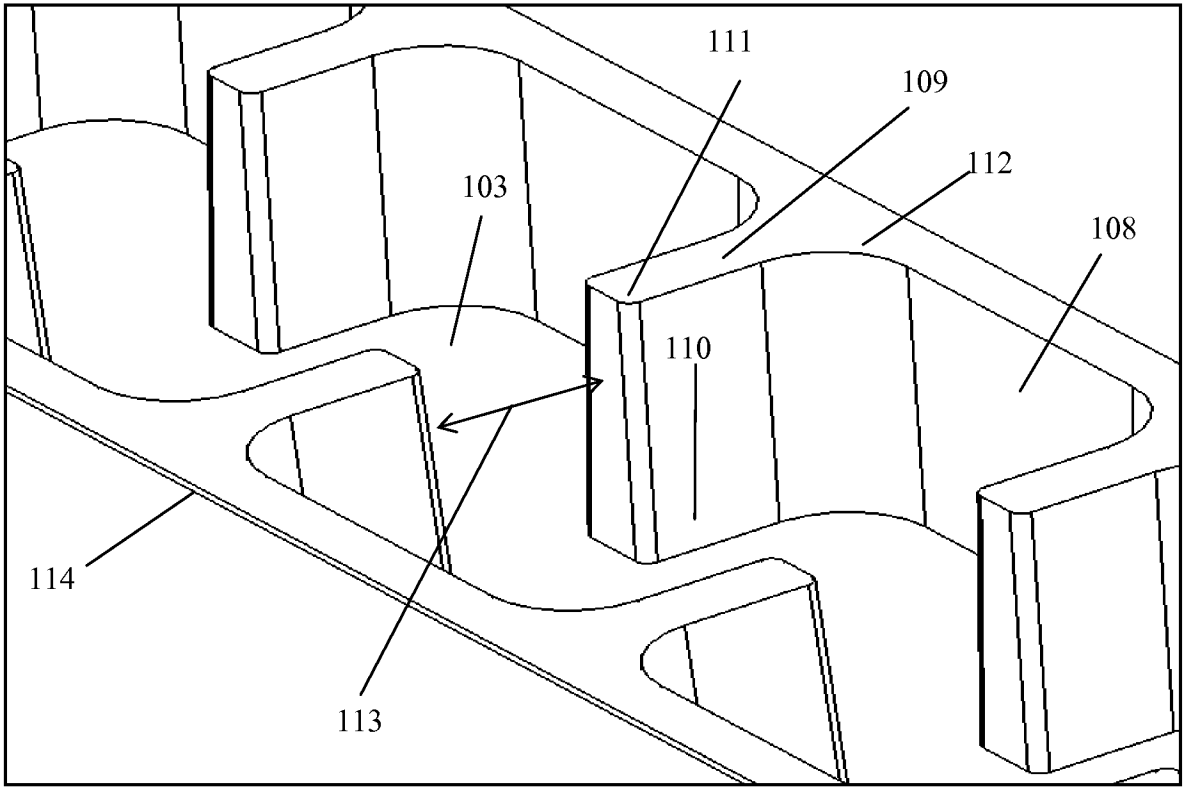
FIG. 2 is a close up view of the diplexer internal structure including inductive iris fingers.

FIG. 2 illustrates several important features of this diplexer embodiment. The filter elements for this embodiment are achieved by coupling a series of irises formed by opposing iris fingers (109) at precise distances along the z-axis from one another. N+1 iris finger-pairs can create N poles of a filter characteristic. The fingers protrude into the waveguide from the waveguide sidewall (108). Opposing fingers create a gap (113), which creates an inductive propagation characteristic that depends on the precise gap distance, the width of the fingers, and to some degree on the lateral position along the a-axis. Magnetic field is concentrated at the finger tips (111), thus the precise geometry of the finger tips is highly influential on the inductance achieved, and the resultant filter characteristic. For the particular embodiment under discussion, the fingers tips are blunt with filleted corners. The radii of the filleted corners are 75 microns. These radii must be controlled to within 5 microns to achieve repeatable results at frequencies covered by WR-12 and WR-15 bands (50-90 GHz). As previously discussed, WEDM technique exhibits the precision and resolution required to create the appropriate tooling to achieve the desired dimensions. Internal corners (112)

require less precision and can be substantially larger than 75 microns while having minimal impact on the design. Along the waveguide channel is a seal ring (114) that serves to concentrate forces at the internal edges of the waveguide channel, and thus provide a good seal along the entire length of the waveguide channel to the lid (150) that encloses the channel. A good seal is required so that parasitic inductances are not created, and so that all energy is contained within the waveguide channel.

An additional feature to note in FIG. 2 is the presence of angled walls in the design. The waveguide width at the floor (103) of the diplexer base is somewhat narrower than at the seal surface (114). This is because the thin iris fingers must not be damaged in the post-mold ejection process, and must have a draft along the direction of ejection. Note that this draft is present along all vertical walls and fingers, and creates a consequent taper to the iris aperture (113). The design of the filter elements must therefore compensate for this non-ideality. Filter performance is impacted very slightly, but in a measurable way.

Figure 3B:
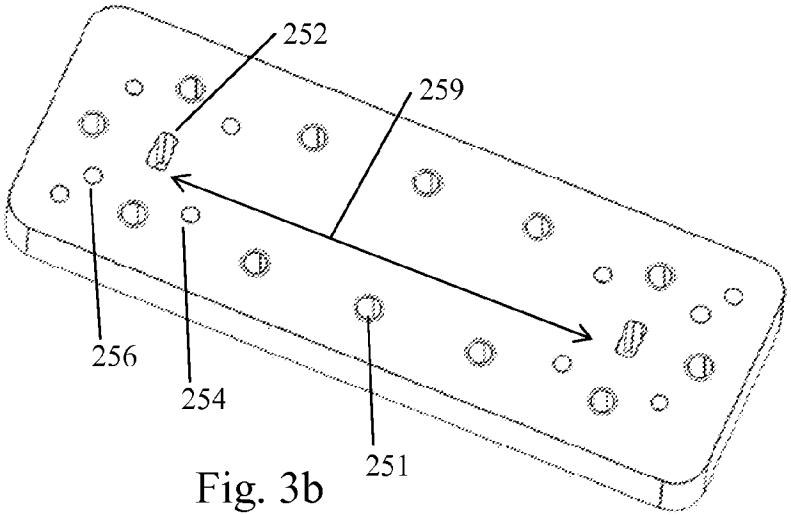
FIGS. 3 and 3*b* illustrate a molded filter base having inductive iris.
Figure 3:
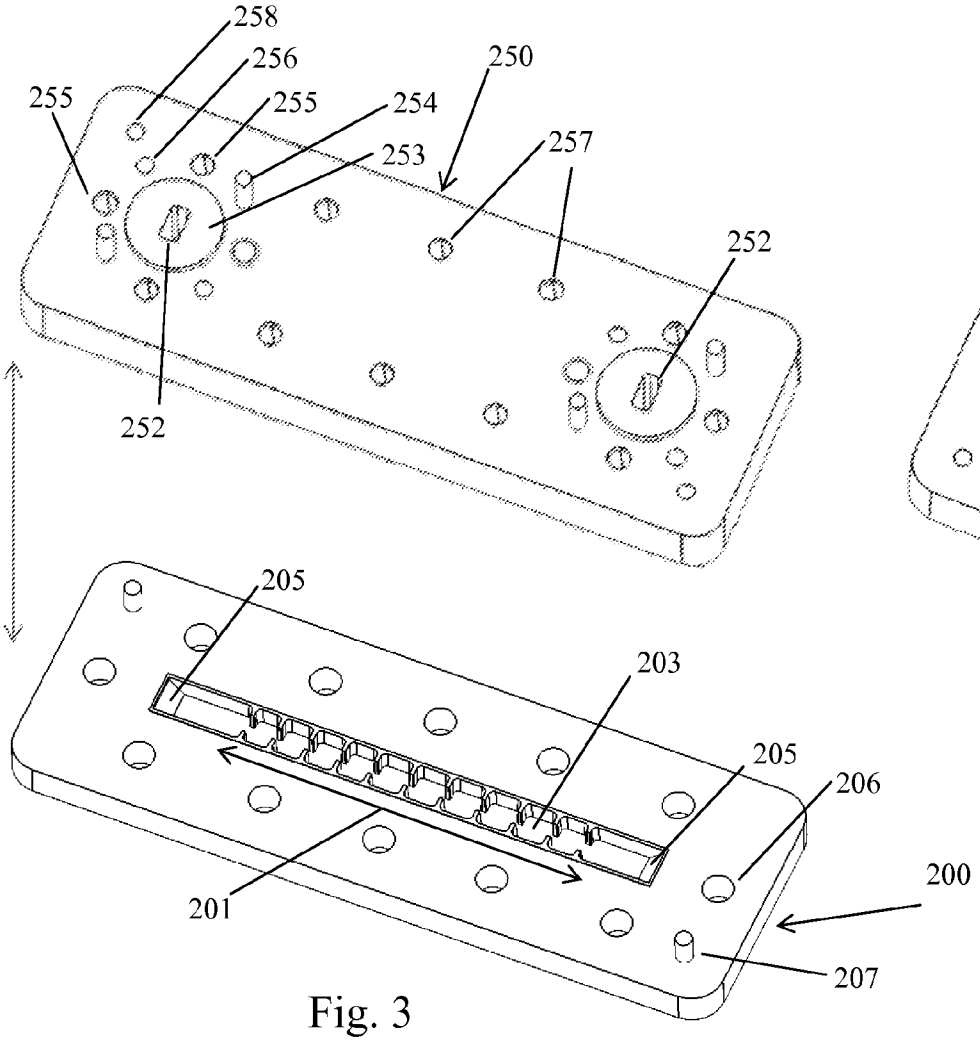

In another embodiment, waveguide filters may be created in a fashion analogous to the inductive iris waveguide diplexer. A filter base (200) and associated lid (250) for such a waveguide device are shown in FIGS. 3 and 3*b*. In particular, FIG. 3 shows a top view of the waveguide and lid as they would be connected to each other to form the component while FIG. 3*b* shows a bottom view of the lid and the portions of the lid that interface with the elements of the waveguide structure. While the diplexer is a three port device, filters are two port devices, not requiring a common port. All the analogous features are depicted, with the exception of common port (151) and the associated common port double wedge (104), which have no analogous parts in the filter, and (102) since a filter requires only a single filter arm. Thus, (201) is a single filter arm, (203) is the waveguide floor, (205) are the bend wedges, (206) are through holes to attach waveguide and clamp the filter base and lid assembly, and (207) is a filter/lid alignment pin. Lid (250) also has analogous features. Thus (252) is the waveguide ports, (253) is the port seal surface, (254) is the waveguide port alignment pin, (255) is the threaded waveguide screw hole, (256) is the waveguide port alignment pin hole, (257) are the auxiliary holes for assembly of lid and base, and (258) are the filter/lid alignment pin holes. (259) depicts the substantially smooth and featureless lid seal area.

Figure 4:
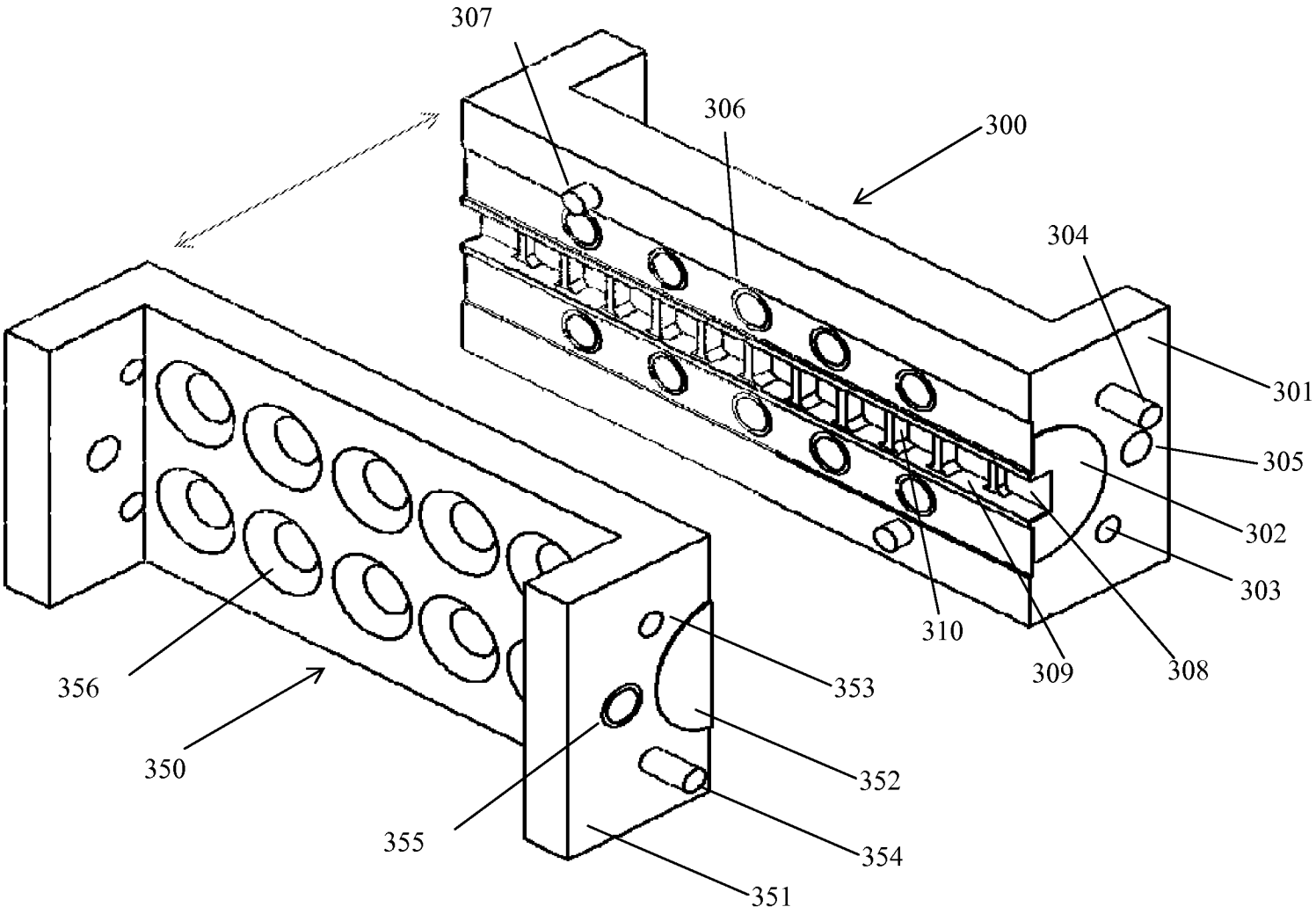
FIG. 4 illustrates the molded filter base and lid with a capacitive iris.

In another embodiment, filters and diplexers may be achieved with capacitive elements. In another unrelated aspect, filters and diplexers may have axially oriented ports. FIG. 4 depicts a filter which has both capacitive elements and axial ports, although such a device may have capacitive elements and non-axial ports, inductive elements and axial ports, and numerous combinations and permutations of ports and element designs within the same device. Many of the features illustrated in FIG. 4 are analogous to those previously discussed in the prior diplexer and filter embodiments. The filter base (300) is similar to filter base (200), while the filter lid (350) is similar to the filter lid (250). The filter is assembled by inserting a series of screws into screw clearance holes (356) and screwing into threaded inserts (306) of the filter base (300). Alignment of the lid and base is achieved by inserting base alignment pin (307) into its complementary alignment pin hole on the lid (350). Mounting flanges (301) and (351) together allow the connection of external waveguide with the same z-axis orientation as the filter. The waveguide seal surface (302) and (352) together allow external waveguide to have intimate contact with the filter assembly. External waveguide components are aligned to the filter by aligning the standard waveguide to waveguide pins (304) and (354), while inserting mating pins into alignment pin holes (303) and (353). Attachment is achieved by screwing into threaded inserts (305) and (355). Note that all the features on the mounting flanges (301) and (351) are perpendicular to the axis of ejection of the molded parts. These features are permitted by incorporating cams and slides into the mold tooling. The cams and slides hold features and inserts in position during the molding process. Once partial cure is achieved, the cams and slides are retracted, and the resultant part may be ejected from the mold tool. Note that all surfaces parallel to the direction of ejection of the parts must have a slight draft, just as required in previous embodiments.

Figure 5:
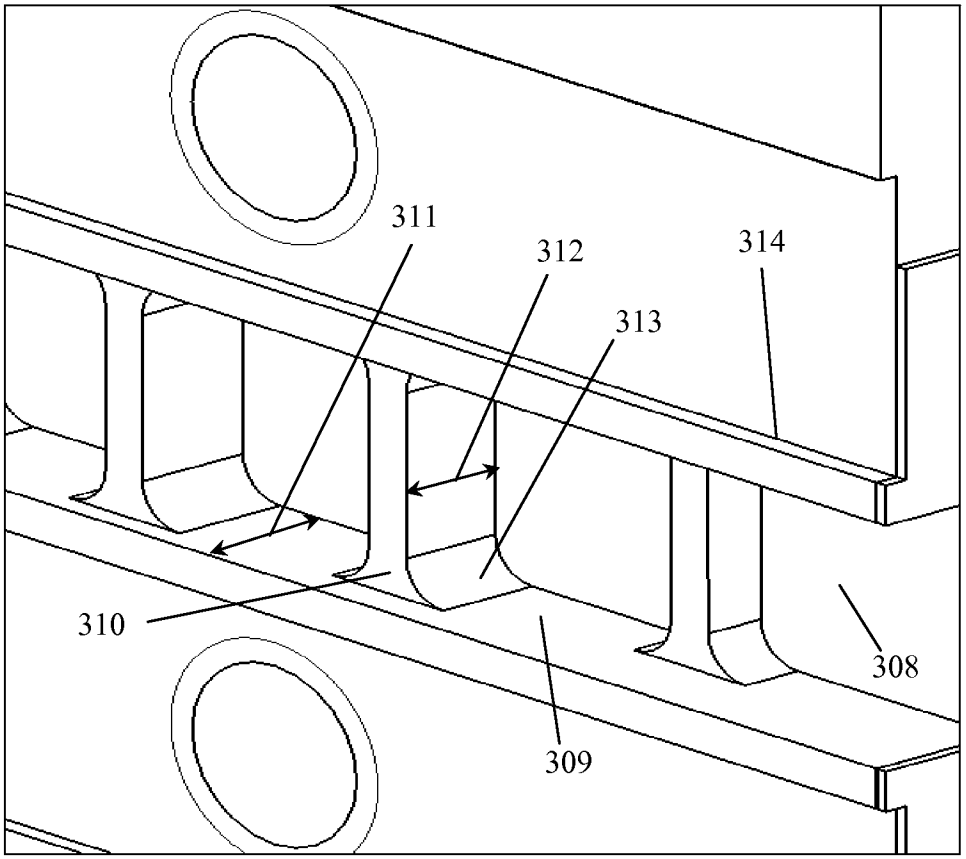
FIG. 5 is a close-up view of the filter internal structure that has capacitive iris walls.

FIG. 5 illustrates some details of the axial capacitive filter design. The distance from the waveguide floor (308) to the top of the seal surface (314) is indicated by measure (311). The distance from the waveguide floor (308) to the top of a representative capacitive wall (310) is indicated by measure (312). The difference between the two measures (311) and (312) is the capacitive gap for this representative wall, also called a capacitive iris. Electric field is concentrated in this iris, thus the precise geometry of the wall creating the iris gap is highly influential on the capacitance achieved, and the resultant filter characteristic formed from the series of capacitive irises. In analogy to the inductive embodiment, N+1 capacitive irises can create N poles of a filter characteristic. The waveguide walls (309) and capacitive walls (310) must have the required draft angle, as previously discussed, to allow ease of ejection of the molded parts.

While the foregoing has been with reference to a particular embodiment of the invention, it will be appreciated by those skilled in the art that changes in this embodiment may be made without departing from the principles and spirit of the disclosure, the scope of which is defined by the appended claims.

The invention claimed is:

1. A waveguide, comprising:

a component with a molded body and one or more internal features, the molded body and the one or more internal features being part of a monolithic construction and being constructed substantially from thermoset resin loaded with ceramic material to achieve a thermal expansion coefficient of less than 12 ppm/° C., the one or more internal features being coated with a conductive layer, and a lid having an inner conductive layer, the lid constructed to permit the attachment of the lid to the component, wherein the component and the lid are attached to each other to create at least one waveguide channel.

2. The waveguide of claim 1, wherein the lid is substantially flat in one or more regions of the lid that form the at least one waveguide channel.

3. The waveguide of claim 1, wherein the one or more internal features are sized and positioned in the component to create a filter of electromagnetic energy.

4. The waveguide of claim 1, wherein the one or more internal features are sized and positioned in the component to create a diplexer of electromagnetic energy.

5. The waveguide of claim 1, wherein the one or more internal features are sized and positioned in the component to create a coupler of electromagnetic energy.

6. The waveguide of claim 1, wherein each conductive layer is at least three skin depths in thickness.

7. The waveguide of claim 1, wherein the thermoset resin loaded with ceramic material has a glass transition temperature in excess of 160° C.

8. The waveguide of claim 1, wherein the ceramic material is loaded with a plurality of spheroidal ceramic particles wherein each particle has a diameter of less than 80 microns.

9. The waveguide of claim 8, wherein said spheroidal ceramic particles are composed of silica.

10. The waveguide of claim 8, wherein said ceramic material is loaded to a percentage in excess of 75 percent with the plurality of spheroidal ceramic particles.

11. The waveguide of claim 1, wherein the component has a plurality of ports for input and output of electromagnetic energy.

12. The waveguide of claim 11, wherein said plurality of ports comprises at least two ports that face in a same direction.

13. The waveguide of claim 11, wherein said plurality of ports comprises at least two ports that do not face in parallel directions.

14. The waveguide of claim 11, wherein said plurality of ports comprises at least one port that is axial to the waveguide channel.

15. The waveguide of claim 11, wherein said plurality of ports comprises at least one port that couples to a waveguide bend, said waveguide bend being a wedge in the vicinity of said waveguide bend.

* * * * *